US007112086B1

(12) United States Patent
Wu

(10) Patent No.: US 7,112,086 B1
(45) Date of Patent: Sep. 26, 2006

(54) ELECTRICAL CABLE ASSEMBLY HAVING CABLE GUIDE

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/101,943

(22) Filed: Apr. 8, 2005

(51) Int. Cl.
*H01R 13/58* (2006.01)

(52) U.S. Cl. ..... 439/460; 439/459; 439/458

(58) Field of Classification Search ..... 439/459, 439/460, 456, 465, 469, 445, 447, 449, 452, 439/455
See application file for complete search history.

(56) References Cited

U.S. PATENT DOCUMENTS

| | | | | | |
|---|---|---|---|---|---|
| 3,777,302 | A | * | 12/1973 | Travis | 439/854 |
| 4,367,005 | A | * | 1/1983 | Douty et al. | 439/357 |
| H379 | H | * | 12/1987 | Alexander, Jr. | 439/610 |
| 4,749,369 | A | * | 6/1988 | Wang | 439/459 |
| 4,761,145 | A | * | 8/1988 | Goto et al. | 439/469 |
| 4,822,286 | A | * | 4/1989 | Bianca | 439/610 |
| 4,838,808 | A | | 6/1989 | Fujiura | |
| 4,842,547 | A | | 6/1989 | Defibaugh et al. | |
| 4,921,456 | A | * | 5/1990 | French | 439/851 |
| 5,372,520 | A | * | 12/1994 | Kilbey et al. | 439/460 |
| 5,383,796 | A | * | 1/1995 | Bowen et al. | 439/469 |
| 5,533,914 | A | * | 7/1996 | Sawada | 439/843 |
| 5,599,212 | A | * | 2/1997 | Sawada | 439/843 |
| 5,611,715 | A | * | 3/1997 | Samejima | 439/850 |
| 5,685,747 | A | * | 11/1997 | Rodriguez | 439/852 |
| 6,012,932 | A | * | 1/2000 | Vanbesien | 439/101 |
| 6,225,547 | B1 | * | 5/2001 | Toyama et al. | 84/611 |
| 6,261,121 | B1 | * | 7/2001 | Harting et al. | 439/469 |
| 6,264,509 | B1 | * | 7/2001 | Kwang et al. | 439/852 |
| 6,431,905 | B1 | * | 8/2002 | Verbeek et al. | 439/456 |
| 6,527,601 | B1 | * | 3/2003 | Chen | 439/852 |
| 6,641,429 | B1 | * | 11/2003 | Wu | 439/465 |
| 6,752,658 | B1 | * | 6/2004 | Jones | 439/581 |
| 6,773,296 | B1 | * | 8/2004 | Kihira et al. | 439/445 |
| 6,840,795 | B1 | * | 1/2005 | Takeda et al. | 439/492 |

* cited by examiner

*Primary Examiner*—Tulsidas C. Patel
*Assistant Examiner*—Harshad C Patel
(74) *Attorney, Agent, or Firm*—Wei Te Chung

(57) ABSTRACT

A cable assembly (100) includes a connector (1) having a mating interface (200) to mate with a mating connector and a rear passage (201), a cable (4) having conductors (40) passing through the rear passage to electrically connect to the connector, and a cable guide (6, 9) attached to the rear passage and dimensioned to hold at least a portion of the cable so as to have the cable extend out of the connector along a pre-determined direction.

13 Claims, 11 Drawing Sheets

ELECTRICAL CABLE ASSEMBLY HAVING CABLE GUIDE

BACKGROUND OF THE INVENTION

1. Field of the Invention

The present invention generally relates to a cable assembly, and more particularly to a cable assembly which having a cable guide for leading extension of the cable.

2. Description of Related Art

A cable assembly comprising a connector and a cable connected to the connector is generally provided for transmitting data between two electronic equipments. A common cable has a moderate flexibility, each of the cables curves moderately at a portion leading out from the connector by a self-weight of the cable, and is adequately contained in the space, hardly causing a problem. However, for obtaining good transmission performance, the cable assembly provided for data transmission between a computer and a server comprises a plurality of differential signal pairs. Correspondingly, a cable has twice many conductors as a conventional cable needs is needed to electrically connect with the corresponding differential signal pairs, therefore, it is hard to leading out the cable with so many conductors from the connector by its self-weight without a worry about transmission problem.

Hence, an improved cable guiding member attached to a cable assembly is highly desired to overcome the disadvantages of the related art.

SUMMARY OF THE INVENTION

Accordingly, an object of the present invention is to provide a cable assembly having a cable extending out along a pre-determined direction.

In order to achieve the object set forth, a cable assembly a connector having a mating interface to mate with a mating connector and a rear passage, a cable having conductors passing through the rear passage to electrically connect to the connector, and a cable guide attached to the rear passage and dimensioned to hold at least a portion of the cable so as to have the cable extend out of the connector along a pre-determined direction.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
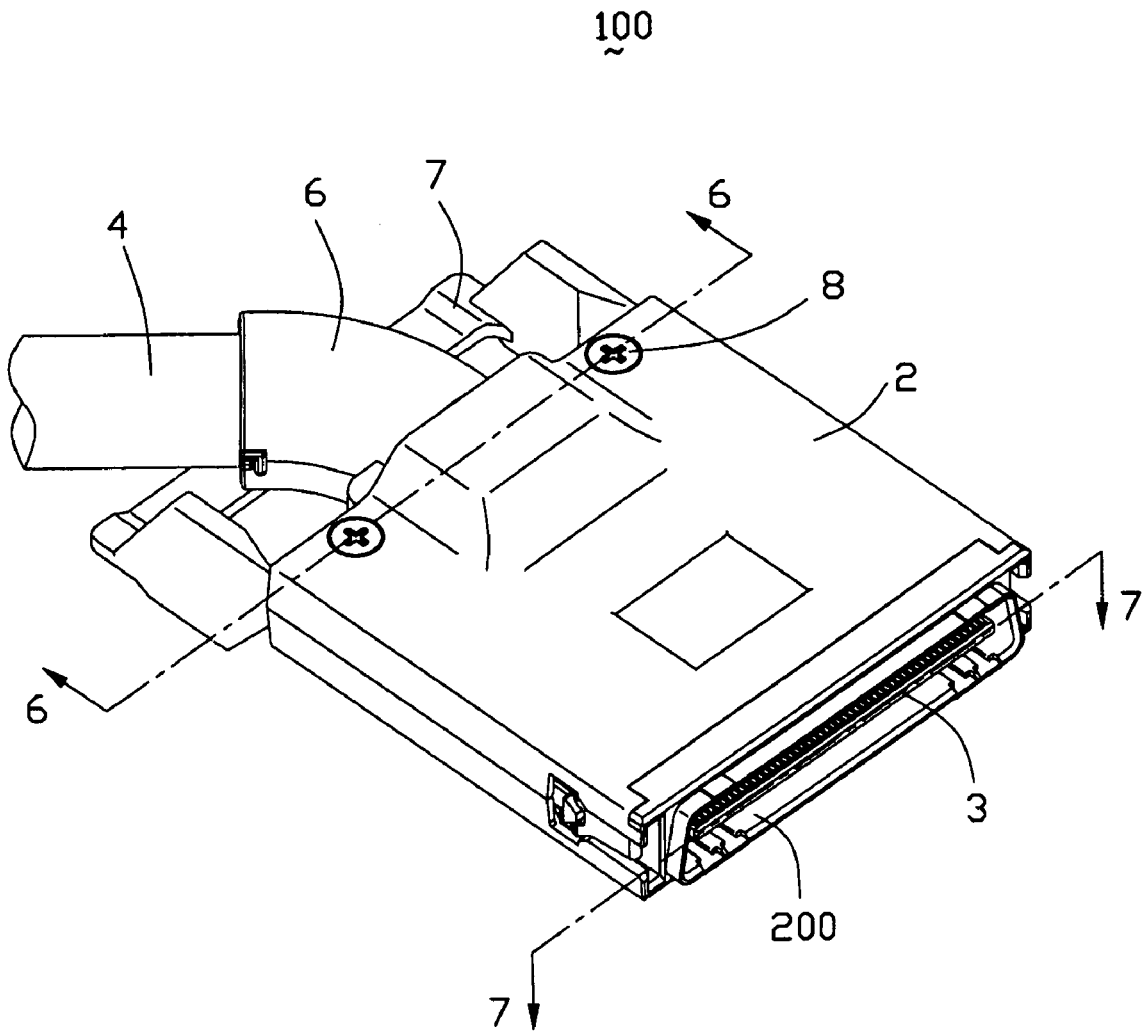
FIG. 1 is an assembled, perspective view of an electrical cable assembly in accordance with the present invention.
Figure 2:
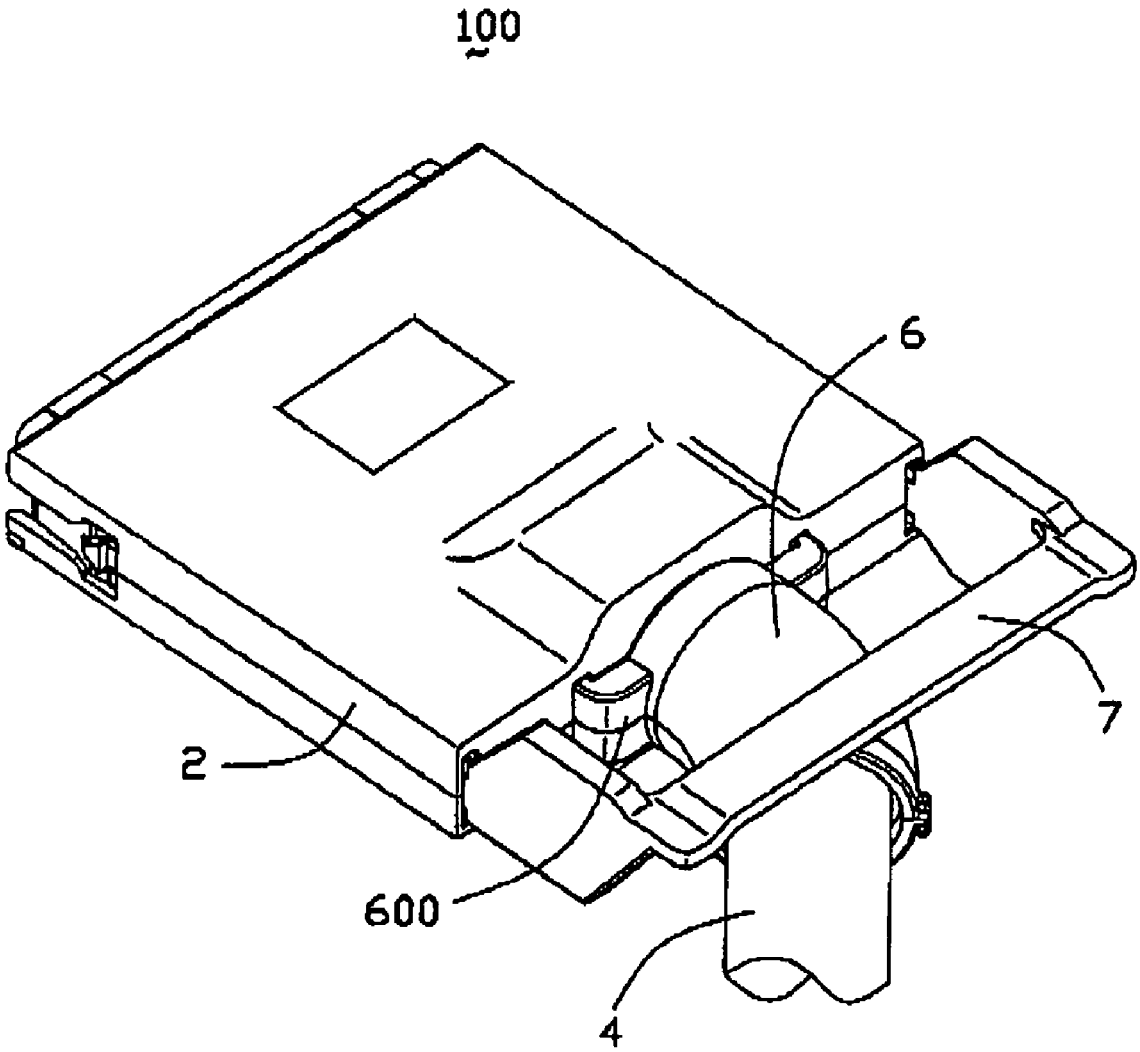
FIG. 2 is a view similar to FIG. 1, but viewed from another aspect.
Figure 3:
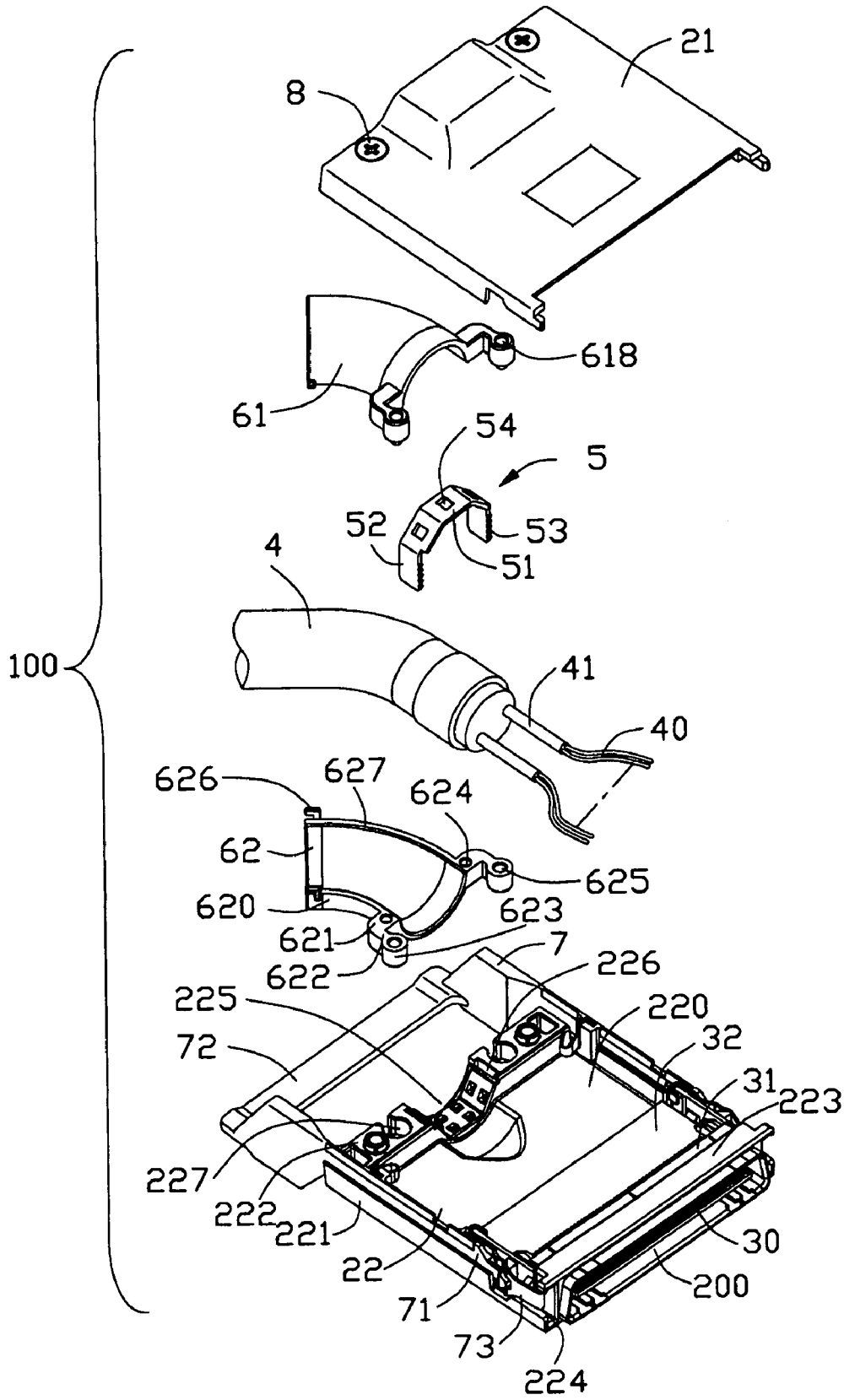
FIG. 3 is an exploded, perspective view of the electrical cable assembly shown in FIG. 1.

Referring to FIG. 1 and FIG. 3, a cable assembly 100 in accordance with the present invention comprises a connector 1 and a cable 4 connected to the connector 1. The connector 1 comprises a metal shell 2 defining a front mating interface 200 and a rear passage (not labeled), a connector module 3 having a plurality of terminals 30 thereon enclosed in the shell 2, a strain relief 5 assembled to the cable 4, a cable guide 6 engaged to a rear side of the shell 2, a latch 7 and a pair of screws 8. The cable 4 has a plurality of conductors 40 electrically connected to the terminals 30 of the connector 1.

Referring to FIG. 1 and FIG. 3, the metal shell 2 is composed of an upper cover 21 and a lower cover 22 mated with the upper cover 21. The lower cover 22 comprises a base plate 220, a pair of side walls 221 upwardly extending from opposite lateral sides of the base plate 220 and a first rear flange 222 having a certain thickness. A mating frame 223 is formed on a front end of the lower cover 22. The mating frame 223 defines the mating interface 200 therethrough. Each side wall 221 defines a top opened first channel 224 extending through the lower cover 22. The first rear flange 222 defines a semicircular-shaped first aperture 225 and a pair of vertical grooves 226 located on opposite lateral sides of the first aperture 225. The first rear flange 222 further defines a pair of rear opened circular first cutouts 227 at outsides of the pair of vertical grooves 226. A pair of rectangular first locating posts 228 (FIG. 4) respectively protrudes upwardly from bottom surfaces of the cutouts 227.

Figure 4:
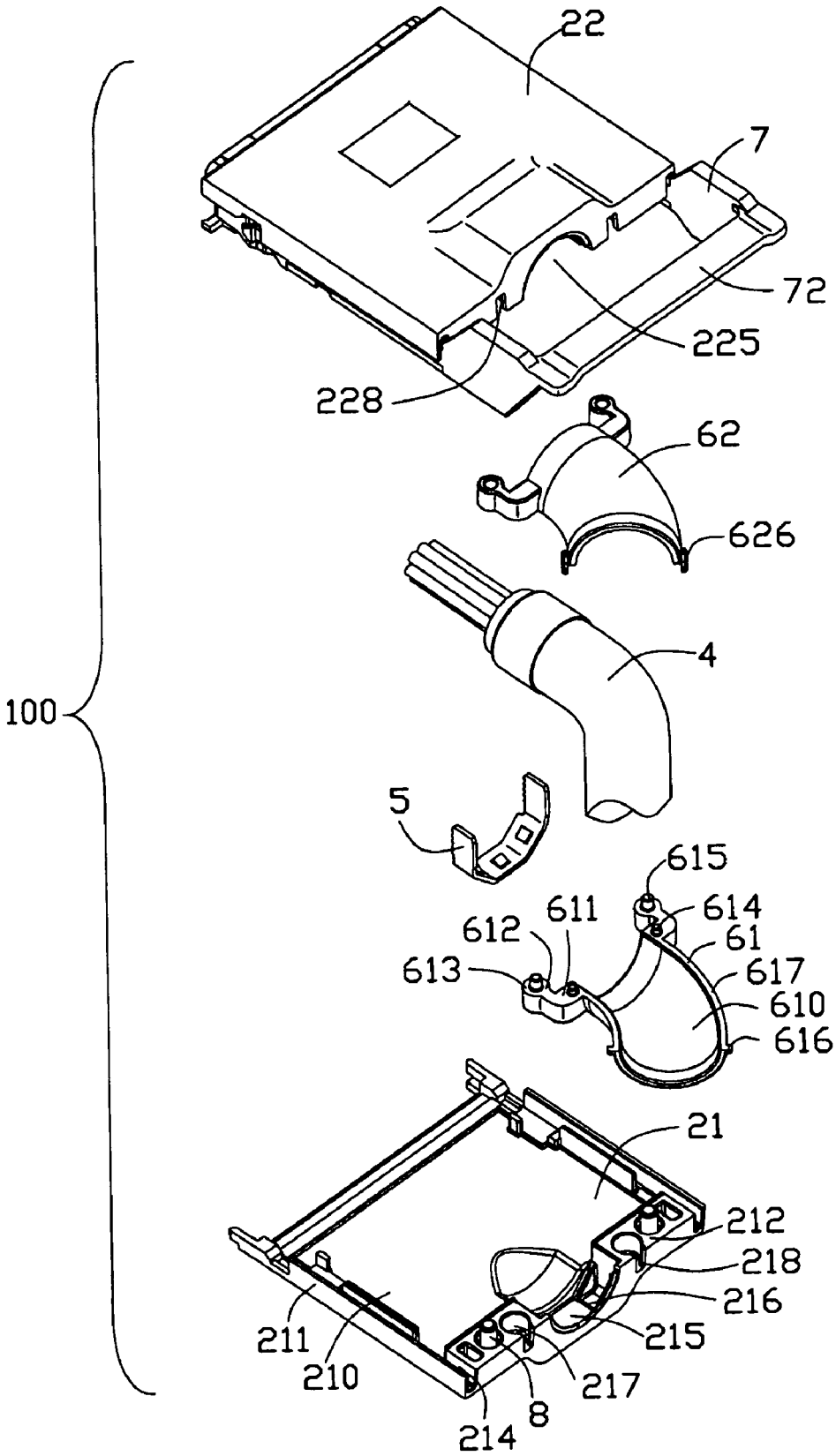
FIG. 4 is an exploded, perspective view of the electrical cable assembly shown in FIG. 2.

Referring to FIG. 4, the upper cover 21 comprises a cover plate 210, a pair of side walls 211 downwardly extending from opposite sides of the cover plate 210 and a second rear flange 212 having a thickness same as that of the first rear flange 222 of the lower cover 22. Each side wall 211 defines a bottom opened second channel 214 corresponding to the first channel 224 of the lower cover 22. The second rear flange 212 defines a semicircular-shaped second aperture 215 in alignment with the first aperture 225 and a pair of circular second cutouts 217 in correspondence with the first cutouts 227. A pair of second locating posts 218 respectively protrudes downwardly from bottom surfaces of the cutouts 217 in alignment with the pair of first locating posts 228 of the lower cover 21. The upper cover 21 further comprises a pair of shot bar 216 on bottom surface of the second aperture 215.

Figure 5:
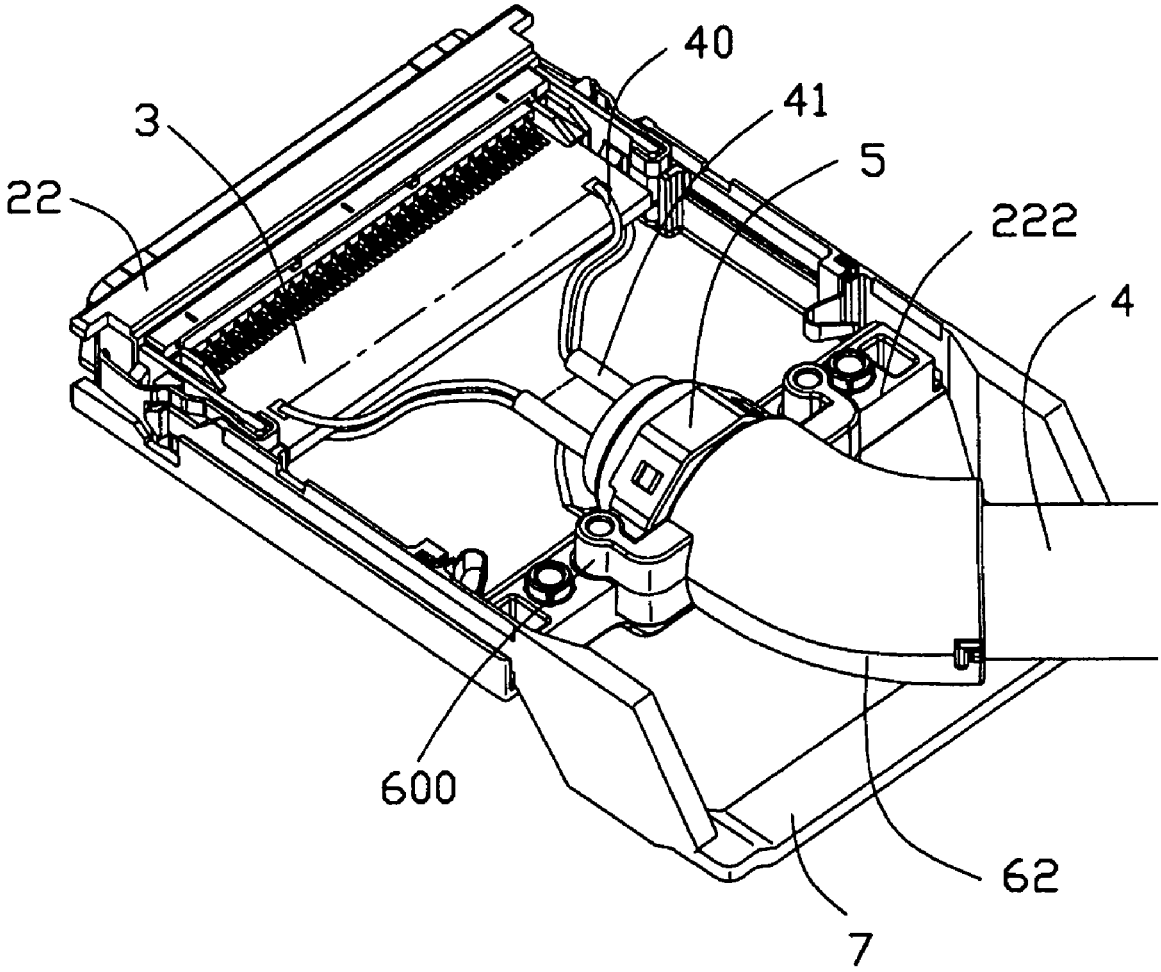
FIG. 5 is a view showing relationship of a cable guide and a lower cover shown in FIG. 3.
Figure 7:
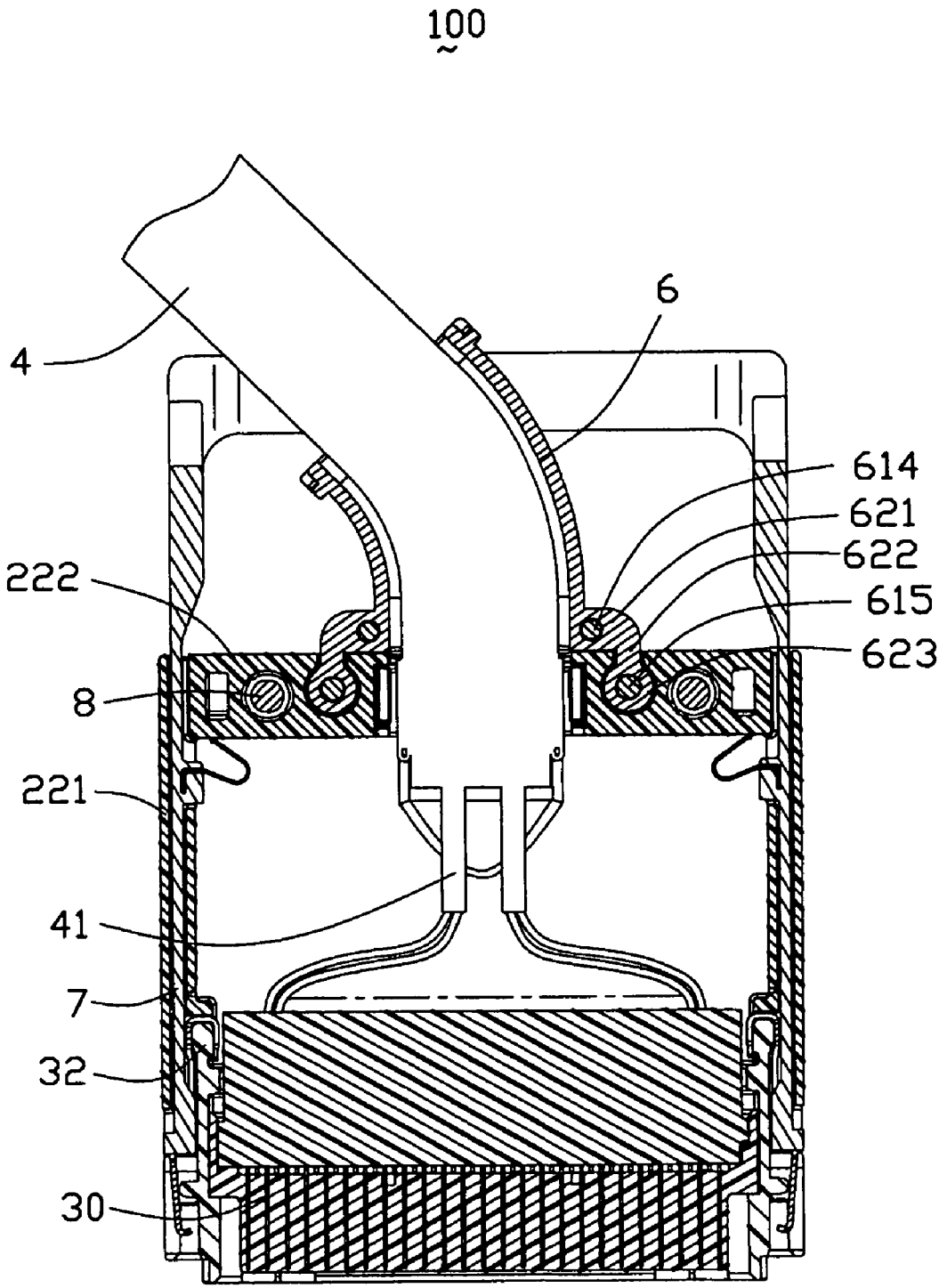
FIG. 7 is a cross-sectional view of FIG. 1 taken along line 7—7.

Referring to FIGS. 3, 5 and 7, the connector module 3 is fittingly disposed in the lower cover 22 and comprises an insulative housing 31 and a circuit substrate 32 assembled to a rear end of the housing 31. The housing 31 defines a plurality of slots (not labeled) therein, the plurality of terminals 30 are respectively received in the corresponding slots with rear ends thereof straddled on the circuit substrate 32 and electrically connected with traces on the circuit substrate 32.

Figure 6:
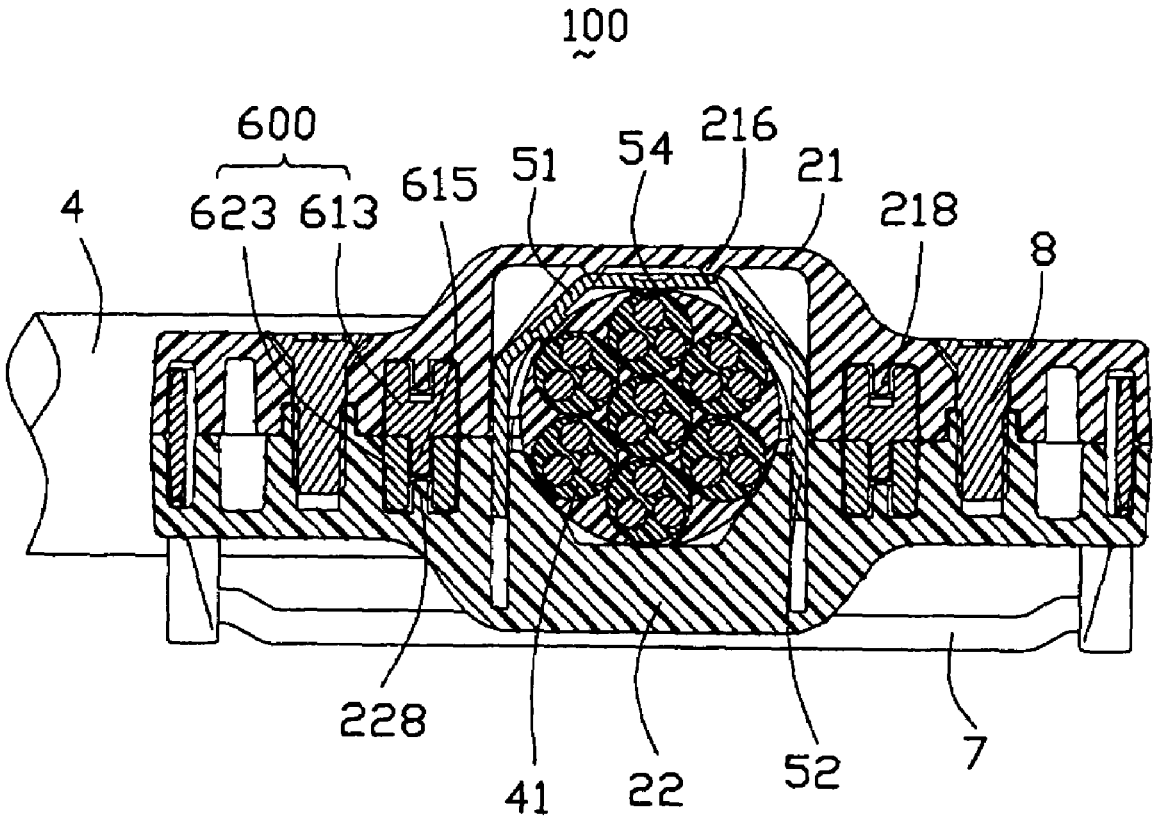
FIG. 6 is a cross-sectional view of FIG. 1 taken along line 6—6.

Particularly referring to FIGS. 3–4 in conjunction with FIGS. 5 and 6, the cable 4 comprises a plurality of sub-wires 41 and an insulating outer jacket (not labeled). The conductors 40 are composed of a plurality of signal wires (not labeled) and a plurality of drain wires (not labeled) for grounding. Each sub-wire 41 comprises a pair of signal conductors each covered with insulative material, a drain wire also covered with insulative material, and a thin aluminum foil (not labeled) enclosing the signal conductors and the drain wire therein.

Referring to FIGS. 3 and 6, the strain relief 5 is typically made of electrical conductive material with high rigidity, such as copper. The strain relief 5 has an arcuate portion 51 and a pair of legs 52 extending downwardly from bottom ends of the arcuate portion 51. Each leg 52 has a plurality of barbs 53 thereon. The arcuate portion 51 has a plurality of securing tabs 54 punched inwardly.

Referring to FIGS. 3–7, the cable guide 6 is configured in a tube form and comprises a pair of engaging portions 600 attached to the shell 2. The cable guide 6 is composed of a first part 61 and a second part 62 coupled with the first part 61. The first part 61 defines a first surface 617 on one side thereof, which is to be joint with a second surface 627 of the second part 62 when the first, second parts 61, 62 are combined with each other. The first part 61 comprises a curved first body portion 610 having a certain curvature radius, a pair of first lateral portions 611 respectively laterally extending from the first body portion 610, a pair of columnar first connecting portions 612 forwardly extending from the first lateral portion 611, a pair of first anchoring portions 613 at front ends of the first connecting portion 612 and a pair of first latching portions 616 at opposite sides of a rear end of the first body portion 610. The anchoring portion 613 has a lateral dimension much more larger than that of the connecting portion 612. The first lateral portion 611 and the first anchoring portion 613 respectively have an interconnecting post 614 and a protrusion 615 extending toward the second part 62 from the first surface 617 of the first part 61. Each first anchoring portion 613 further defines a sunken portion 618 opposite to the protrusion 615.

Particularly referring to FIG. 3, the second part 62 of the cable guide 6 has a configuration similar to the first part 61 and comprises a curved second body portion 620, a pair of second latching portions 626 for respectively latching to the first latching portions 616 of the first part 61, and a pair of second lateral portions 621, second connecting portions 622 and second anchoring portions 623, which are respectively in correspondence with the first lateral portions 611, the first connecting portions 612 and the first anchoring portions 613 of the first part 61. The second lateral portion 621 defines a first recess 624 in the second surface 627. Each second anchoring portion 623 defines a second recess 625 therethrough for receiving the locating post 228 and the first positioning portion 615. The second latching portion 626 is configured in an L-shape so as to lock with the first latching portion 616 of the first part 61.

For facilitating detachment of the cable assembly 100 from a complementary connector (not shown), the latch 7 is provided. The latch 7 is assembled to the lower cover 22 with two arm portions 71 respectively received in the first channels 224. An operating portion 72 connects the two arm portions 71 and locates behind the first rear flange 222 of the lower cover 22. The latch 7 further comprises a pair of elastic metal claws 73 respectively assembled to the arm portions 71 for latching with the complementary connector.

Referring to FIGS. 1–9, the connector module 3 is assembled in the lower cover 22 and is accessible from the mating interface 200. The second part 62 of the cable guide 6 is assembled to the lower cover 22 with the second anchoring portions 623 respectively disposed in the second cutouts 227, and with the first connecting portions 622 properly passing through rear openings of the cutouts 227. The first locating posts 227 of the lower cover 22 are inserted into the second recess 625 of the second anchoring portions 623. The cable 4 is then provided for extending through the first aperture 225 with the conductors 40 electrically connecting to circuit traces on the circuit substrate 32, therefore establishing electrical connection between the conductors 32 and the terminals 30 via circuit substrate 32. The cable 4 held and led out by the first body portion 620 of the first part 61. The strain relief 5 is assembled to the lower cover 22 with legs 52 respectively inserted into the grooves 226. The barbs 53 interferencely engage with inner walls of the grooves 226. The arcuate portion 51 covers on the cable 4 with the securing tabs 504 abutting against the exposed out jacket of the cable 4. The first part 61 is then attached to the second part 62 with the cable 4 extending therebetween. The interconnecting posts 614 are respectively received in the first recesses 624 of the second part 62. Accordingly, the protrusions 615 are respectively inserted into the second recesses 625 from a top side of the second part 62. At the rear end of the cable guide 6, the first latching portions 616 and the second latching portions 626 are locked with each other. Particularly referring to FIG. 6, the first anchoring portions 613 and the second anchoring portion 623 are combined to form the pair of engaging portions 600 of the cable guide 6.

The upper cover 21 is assembled to the lower cover 22. The first aperture 225 and the second aperture 215 are joined together to form the rear passages holding the cable 4 and the strain relief 5. Specially, the first anchoring portions 613 of the first part 61 are received in the corresponding second cutouts 217, and the second locating posts 218 of the upper cover 21 are respectively received in the corresponding sunken portions 618 of the first part 61. The engaging portions 600 are reliably held between the upper and the lower covers 21, 22. The screws 8 are assembled to the upper cover 21 and the lower cover 22 to form the shell 2 enclosing the cable 4 and the connector module 3 therein.

Figure 8:
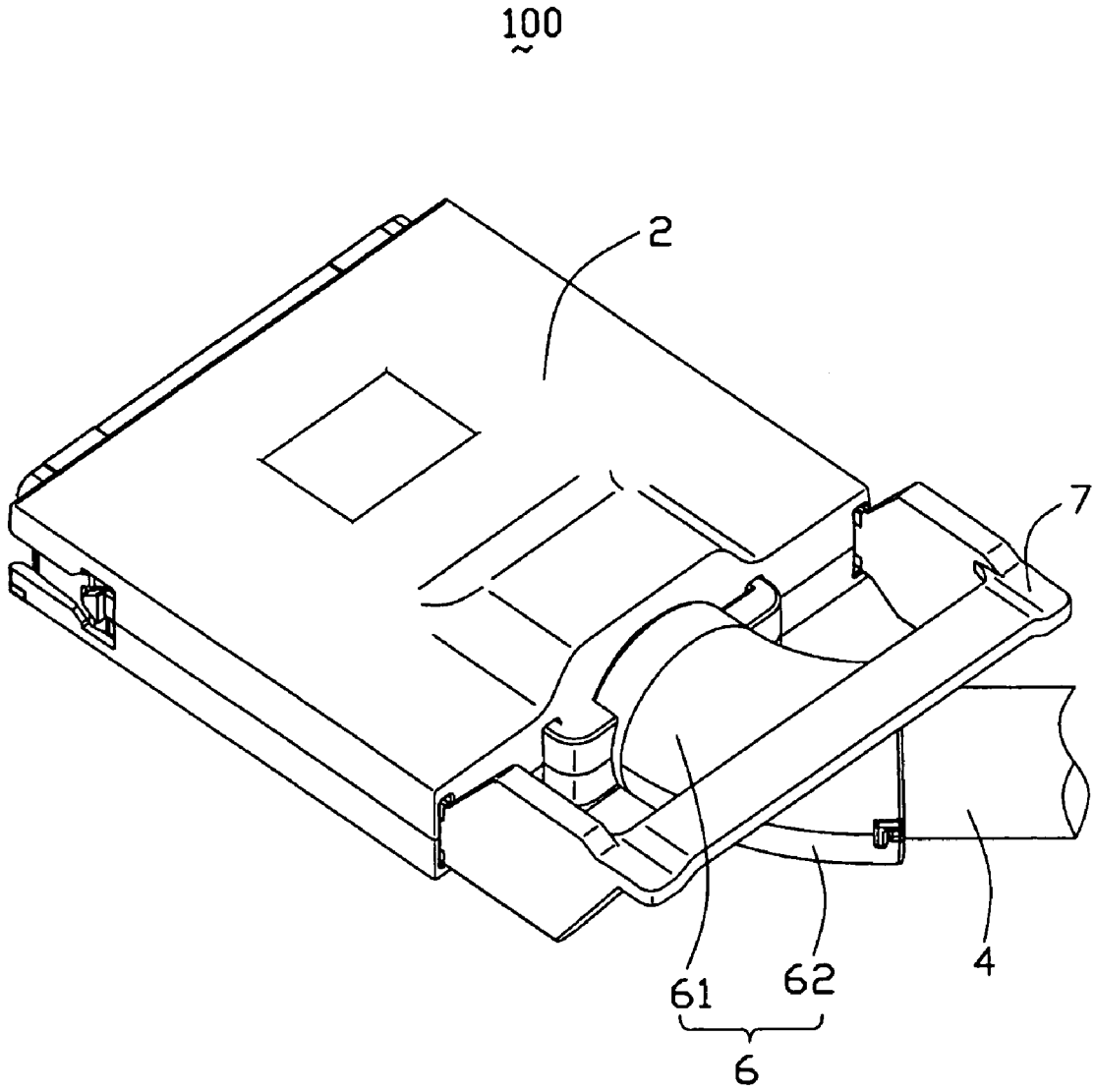
FIG. 8 is a perspective view of the cable assembly shown in FIG. 2 with a cable guide attached in an opposite direction.

Referring to FIG. 8, the first part 61 of the cable guide 6 is in engagement with the upper cover 21, and the second part 62 is attached to the lower cover 21. Therefore, the cable guide 6 leads out the cable 4 from the shell 2 in a direction opposite to the extension direction of the cable 4 shown in FIG. 2. Obviously, the structure in which the cable guide 6 can be attached to the shell 2 in a different direction is useful in many applications.

Figure 9:
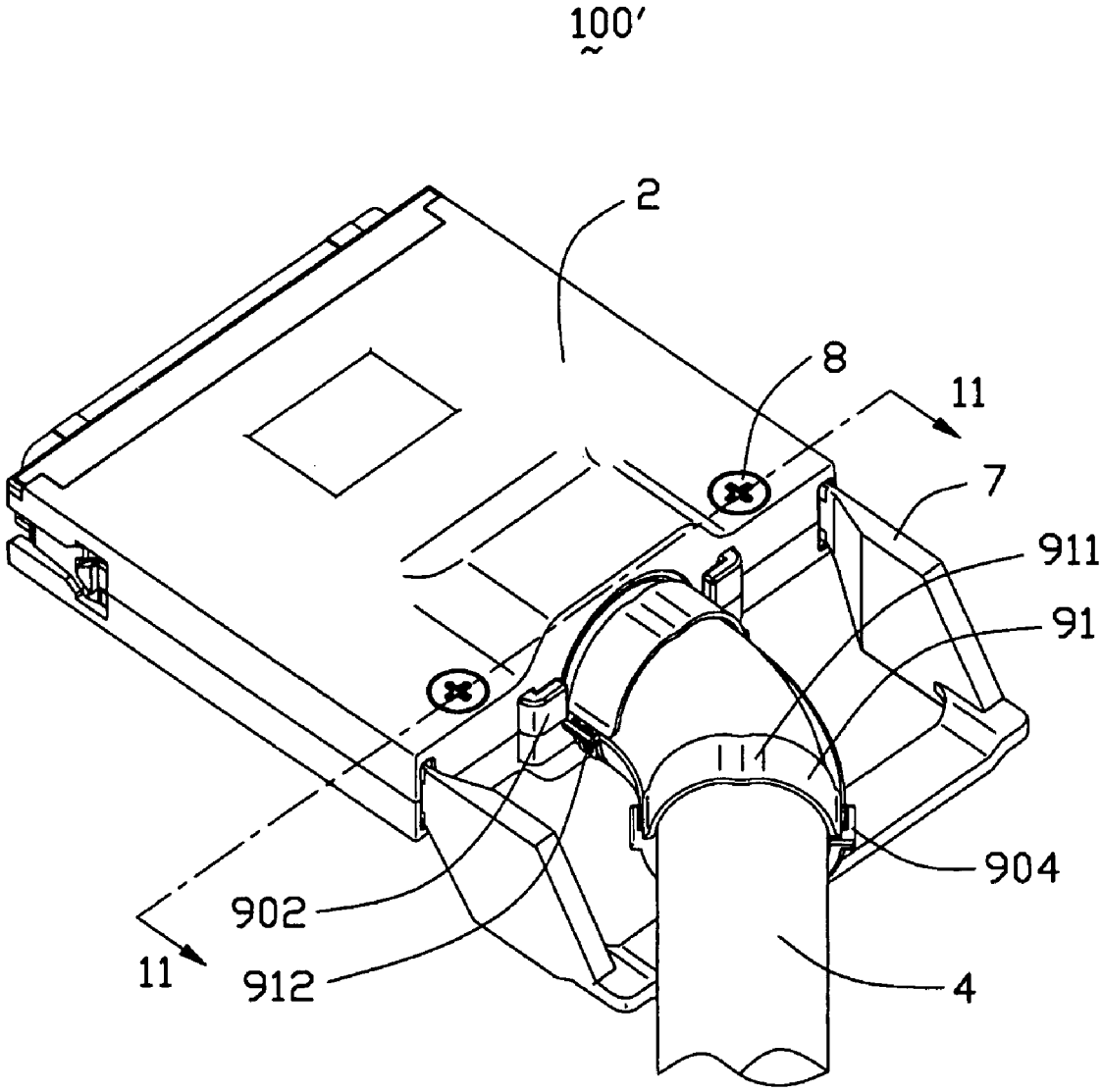
FIG. 9 is an assembled, perspective view of a connector assembly in accordance with a second embodiment of the present invention.
Figure 10:
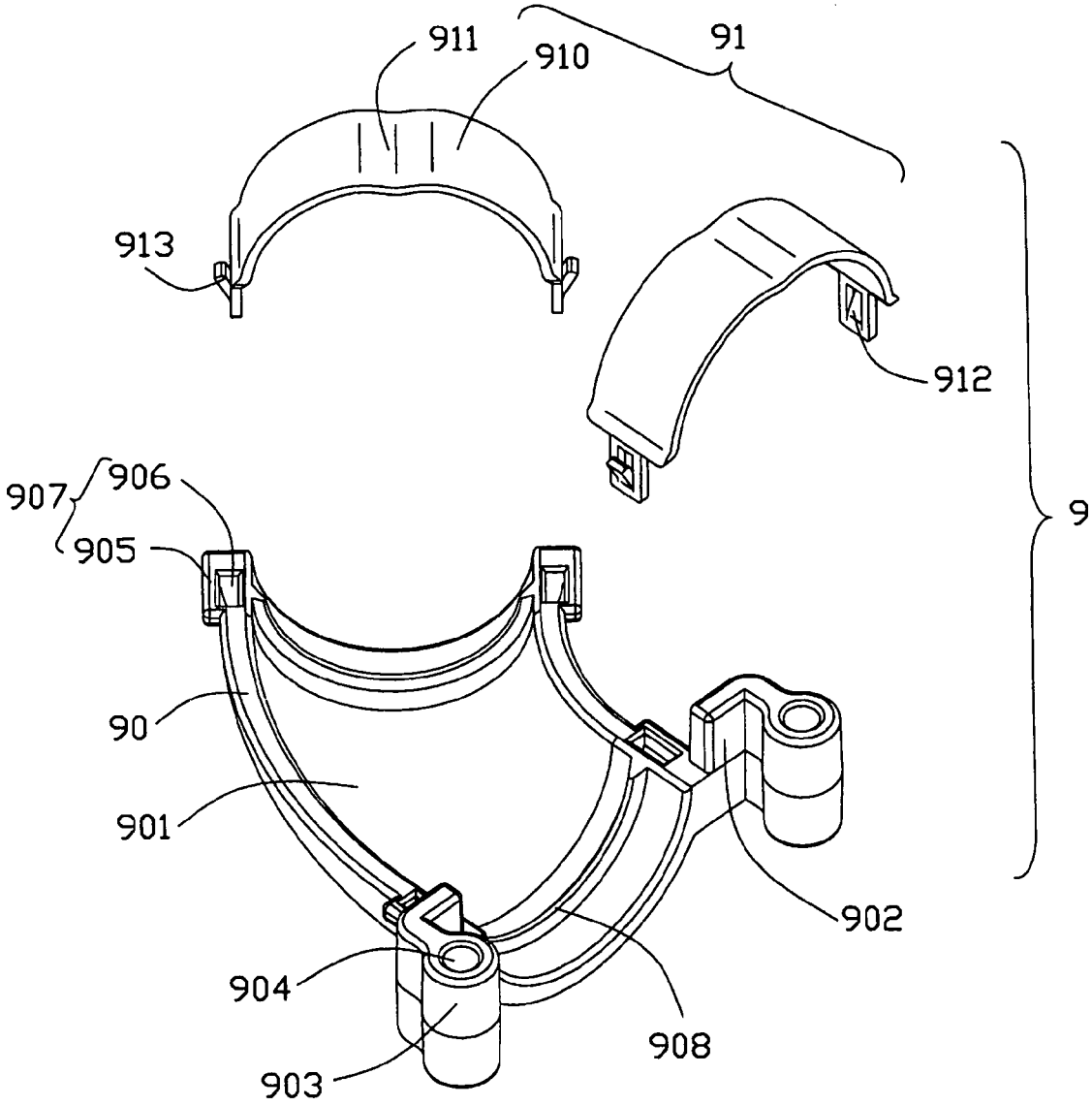
FIG. 10 is an enlarged, perspective view of a cable guide shown in FIG. 9.
Figure 11:
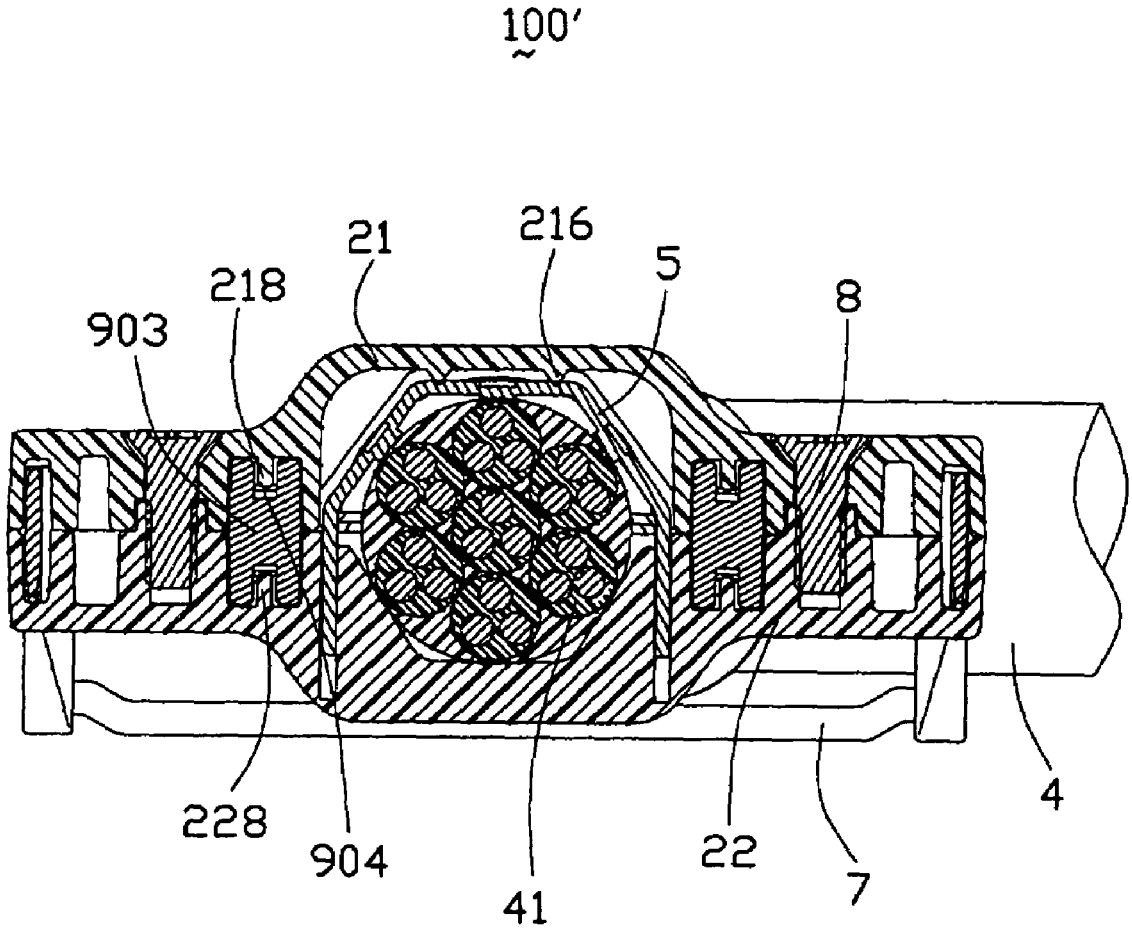
FIG. 11 is a cross-sectional view of FIG. 9 taken along line 11—11.

FIGS. 9–11 show another embodiment of the present invention. The cable assembly 100' is same to the cable assembly 100 except for a cable guide 9. The cable guide 9 comprises a base part 90 and a retention part 91 attached to the base part 90 with the cable 4 extending therethrough. The base part 90 defines a curved channel 901 therethrough for fittingly partially receiving the cable 4 therein. A pair of ribs 908 are formed on inner surface of the channel 901 at opposite ends for reliably securing the cable 4. The base part 90 comprises a pair of L-shaped linking portions 902 at a front end and a pair of columnar engaging portions 903 connecting with the linking portions 902. Each engaging portion 903 defines a pair of receiving recesses 904 oppositely recessed from top and bottom sides thereof. It is also acceptable to define a groove through each engaging portion 902. The base part 90 has a semicircular cross section and comprises two pairs of locking portions 907 at front and rear ends thereof. In this embodiment, each locking portion 907 defines a hollow 906 through, thus, forming a retention bar 905 at an outside of the hollow 906. The retention part 91 is formed by a pair of arcuate clasps 910. Each clasp 910 has a cross section approximate to the semicircular, and comprises a deforming portion 911 at the middle thereof and a pair of fasteners 912 at opposite ends. The deforming portion 911 is configured in a crapy form. Each fastener 912 has an outwardly protruding tab 913 for locking to the base part 90.

Particularly referring to FIG. 11, the engaging portions 902 of the base part 90 are disposed between the upper and the lower covers 21, 22 with the first and the second locating posts 218, 228 received in the corresponding receiving recesses 904. The screws 8 are assembled to the upper cover 21 and the lower cover 22. Consequently, the pair of clasps 911 is attached to the base part 90, with the fasteners 912 passing through the corresponding hollows 906 to lock the tabs 913 thereon with the corresponding bars 905 of the base part 90. As the deforming portion 911 is crapy, the deforming portion 911 creates a spring force to secure the cable 4 between the retention part 91 and the base part 90. In other embodiments, the retention part 91 and the base part 90 can be combined together in other engaging, locking or latching ways via different simple configurations. Besides, the short bars 216 on the upper cover 21 are tightly compressed to the strain relief 5 for increasing securing force.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

What is claimed is:

1. A cable assembly, comprising:

a connector having a front mating interface to mate with a mating connector, and a rear passage;

a cable having a plurality of conductors passing through the rear passage to electrically connect to the connector; and a cable guide being discrete from the connector and attached to rear portion of the connector and dimensioned to hold at least a portion of the cable so as to have the cable extend out of the connector along a pre-determined direction;

wherein the cable guide comprises a base part and a retention part latched to the base part so as to hold the cable therebetween;

wherein the base part comprises a pair of engaging portions at a front end thereof attached to the rear portion of the connector so as to assemble the cable guide to the connector;

wherein the connector comprises a connector module accessible from the mating interface, an upper cover and a lower cover jointed to the upper cover to enclose the connector module therein, and wherein the engaging portions of the cable guide are held between the upper and the lower covers; the rear cover further defines a stopping portion at each end thereof;

wherein the lower and the upper covers respectively comprise a first rear flange and a second rear flange confronting to the first rear flange;

wherein the first rear flange defines a first semicircular aperture and a pair of rear opened first cutouts at opposite sides of the first aperture, the second rear flange defines a second aperture and a pair of second cutouts respectively in alignment with the first aperture and the first cutouts, and wherein the first aperture and the second aperture together form the rear passage to hold the cable while the first cutout and the corresponding second cutout joint together to completely receive one of the engaging portions therein.

2. The cable assembly as claimed in claim 1, wherein the base part of the cable guide defines a channel curving by a specific curvature therethrough for partially receiving and leading the cable extending along the pre-determined direction.

3. The cable assembly as claimed in claim 1, wherein the retention part of the cable guide is composed of two clasps, each clasp has a pair of fasteners thereon for locking with corresponding portion of the base part.

4. The cable assembly as claimed in claim 3, wherein each clasp of the retention part has a deforming portion at the middle thereof to create spring force to hold the cable.

5. The cable assembly as claimed in claim 1, wherein the engaging portion is configured in a columnar form.

6. The cable assembly as claimed in claim 1, wherein the connector module comprises a circuit substrate extending toward to the rear portion of the connector to electrically connect with the cable.

7. The cable assembly as claimed in claim 1, wherein the connector comprises a strain relief assembled to the cable between the upper cover and the lower cover.

8. The cable assembly as claimed in claim 1, wherein the connector comprises a latch assembled between the combinable upper and lower covers for facilitating detachment of the cable assembly from a complementary connector.

9. A cable assembly comprising:

a connector having a front mating portion for mating with a mating connector, and a cable passage formed in a cover device which includes opposite top and bottom covers;

a cable having a plurality of conductors passing through the cable passage to electrically connect to the connector; and a cable guide attached to one side of the cover device of the connector and dimensioned to hold at least a portion of the cable so as to have the cable extend out of the connector along a pre-determined direction; wherein the cable guide includes upper and bottom parts not only latchably complementarily engaged with corresponding upper and bottom covers, respectively, but also with each other;

a latch attached to said side and overlapped with said cable guide in a vertical direction;

wherein said latch is moveable along a front-to-back direction while said cable guide extends in an oblique direction.

10. The cable assembly as claimed in claim 9, wherein one of the upper and bottom parts includes a protrusion and the other includes a receiving hole receiving said protrusion along a vertical direction.

11. A cable assembly, comprising:

a connector having a front mating interface to mate with a mating connector, and a rear passage;

a cable having a plurality of conductors passing through the rear passage to electrically connect to the connector; and a cable guide attached to rear portion of the connector and dimensioned to hold at least a portion of the cable so as to have the cable extend out of the connector along a pre-determined direction;

wherein the cable guide comprises a base part and a retention part latched to the base part so as to hold the cable therebetween;

wherein the base part comprises a pair of engaging portions at a front end thereof attached to the rear portion of the connector so as to assemble the cable guide to the connector;

wherein the connector comprises a connector module accessible from the mating interface, an upper cover and a lower cover jointed to the upper cover to enclose the connector module therein, and wherein the engaging portions of the cable guide are held between the upper and the lower covers;

wherein the lower and the upper covers respectively comprise a first rear flange and a second rear flange confronting to the first rear flange;

wherein the first rear flange defines a first semicircular aperture and a pair of rear opened first cutouts at opposite sides of the first aperture, the second rear flange defines a second aperture and a pair of second cutouts respectively in alignment with the first aperture and the first cutouts, and wherein the first aperture and the second aperture together form the rear passage to hold the cable while the first cutout and the corresponding second cutout joint together to completely receive one of the engaging portions therein.

12. The cable assembly as claimed in claim 1, wherein the upper and the bottom covers are made from metal material.

13. The cable assembly as claimed in claim 1, wherein each conductor of the cable has a pair of signal conductor and a grounding conductor.

* * * * *